US005617208A

United States Patent [19]

Alumbaugh et al.

[11] Patent Number: 5,617,208

[45] Date of Patent: Apr. 1, 1997

[54] IGNITION DETECTION METHOD AND DEVICE FOR A REACTION VESSEL

[75] Inventors: William H. Alumbaugh; Gregory J. Hill, both of Pensacola, Fla.

[73] Assignee: Huntsman Petrochemical Corporation, Salt Lake City, Utah

[21] Appl. No.: 383,000

[22] Filed: Feb. 3, 1995

[51] Int. Cl.[6] ..... G01B 11/00

[52] U.S. Cl. ..... 356/375; 250/554

[58] Field of Search ..... 356/375; 250/554, 250/339.15

[56] References Cited

U.S. PATENT DOCUMENTS

| | | | |
|---|---|---|---|
| 3,613,062 | 10/1971 | Bloice | 356/218 |
| 4,910,501 | 3/1990 | Montoya | 356/554 |
| 4,964,388 | 10/1990 | Lefebvre | 123/435 |
| 5,120,975 | 6/1992 | Fedor et al. | 250/554 |

*Primary Examiner*—Richard A. Rosenberger

*Attorney, Agent, or Firm*—Senniger, Powers, Leavitt & Roedel

[57] ABSTRACT

A method for detecting a source of ignition in a zone of a reactor vessel involving the optical measurement of the progress of a flame front generated by the ignition. The ignition is sensed and the time thereof measured and recorded. A photosensor senses the entry of the flame front into its view aperture and the time thereof is measured. The time of the ignition is compared to the time of the flame front's entry into the photosensor's view aperture. Further, an apparatus for determining the location of ignition of combustion in a reactor zone having a means for detecting the ignition and a plurality of photosensors for characterizing the accompanying flame front's progression. Also, a photosensor assembly for use in connection with the method and apparatus.

22 Claims, 7 Drawing Sheets

RX 3 EVENT PHOTODIODES
PHOTODIODE OUTPUT, VOLTS
TIME, MSEC
TEE RD + RD2
◇ RD3
△ RD4
× RD5
▽ RD6
8MS
14MS
16MS
3
2.8
2.6
2.4
2.2
2
1.8
1.6
1.4
1.2
1
0.8
0.6
0.4
0.2
0
-100
-80
-60
-40

IGNITION DETECTION METHOD AND DEVICE FOR A REACTION VESSEL

BACKGROUND OF THE INVENTION

This invention relates to a method and device for detecting the ignition of an explosion within a combustible gas mixture, e.g., in a gas stream flowing through a reaction vessel, and locating the point of ignition. The invention also relates to a process for producing maleic anhydride using the ignition detection method and device.

A number of industrial chemical reactions occur under conditions which occasionally result in events such as deflagrations or detonations which, though typically not catastrophic, can result in costly process interruptions, waste of reactants, and the like. For example, in the catalytic partial oxidation of hydrocarbons, a combustible mixture of hydrocarbon and air may be introduced into the reaction zone. If conditions are not adequately controlled ignition can occur, resulting in a deflagration. It is desirable to detect the point of ignition of such events so that steps can be taken to minimize the risk of future events. Identifying the point of ignition may help identify locations where surface chemistry or local stream parameters are conducive to ignition. However, reaction vessels are typically closed and the propagation of flame fronts associated with such events are rapid, so that it is often not possible to locate the ignition point visibly or easily by other means.

SUMMARY OF THE INVENTION

It is an object of the invention to provide a method for detecting the ignition of uncontrolled reactions, including explosions, in a combustible gas and determining the location of such ignition. It is a particular object of the invention to provide a method for determining the point of ignition within a closed reaction vessel. It is a further object to provide an apparatus effective to detect ignition and determine the location thereof, preferably substantially the exact point of the ignition.

Briefly, therefore, the invention is directed to a method for detecting a source of ignition in a zone containing a combustible gas by optical measurement of the progress of a flame front generated by the ignition. The ignition is sensed and the time at which the ignition is sensed is recorded. The entry of the flame front into the view aperture of a photosensor spaced from said point of ignition is sensed, the time thereof measured, and the time of ignition and the time of the entry are compared.

The invention is also directed to an apparatus for determining the location of ignition of combustion in a zone containing a combustible gas mixture. The apparatus comprises a means for detecting ignition, a means for recording the time of ignition, a plurality of photosensors arrayed so that their view apertures extend into the zone containing the combustible gas mixture but are spaced from the point of ignition. Each of the photosensors generates a signal upon entry of the flame front produced by the combustion into the view aperture of such photosensor. The apparatus further comprises a means for recording the time at which each photosensor signal is generated whereby, from the time difference between the ignition and the time the flame front enters the view aperture of each of the plurality of photosensors, a function may be determined relating a surface in which the point of ignition must lie to the velocity of the flame front.

Finally, the invention is directed to a photosensor assembly for use in detecting the location of an ignition within a reactor. The assembly includes a light sensing means for detecting the propagation of a flame front and a nozzle for communication of the light sensing means with light sources within the reactor.

Other objects and features of the invention will be in part apparent and in part pointed out hereinafter.

DETAILED DESCRIPTION OF THE INVENTION

The present invention provides a method and apparatus for detecting the ignition of uncontrolled reactions such as explosions, including deflagrations and detonations, within a combustible gas mixture, and determining the location of ignition. In particular, the invention provides such a method and apparatus for determining the location of ignition in a closed reactor vessel. The apparatus of the invention comprises a device which detects the ignition of a reaction and causes the time of such ignition to be recorded. A plurality of photosensors are arrayed so that their view apertures extend into the zone containing the combustible gas mixture, e.g., the interior of a reactor vessel. After ignition, each of the plurality of photosensors detects the propagation of the flame front produced by the reaction and generates a signal when the propagating flame front enters the view aperture of such photosensor. This signal is recorded to establish a record of the time at which the flame front enters that view aperture. For each of the plurality of photosensors, a time difference is determined between the entry of the flame front into the view aperture of the photosensor and the time of ignition as initially detected. The time differences among the plurality of photosensors are compared, such that the location of the ignition is determined.

Because the response time for each photosensor is less than ten microseconds, the rapidity of flame front propagation does not prevent its being characterized by the photosensors. By determining the location of ignition, steps can be taken to minimize the risk of future events, and the risk of corresponding process interruptions, waste of reagents, and the like can be minimized.

Figure 1:
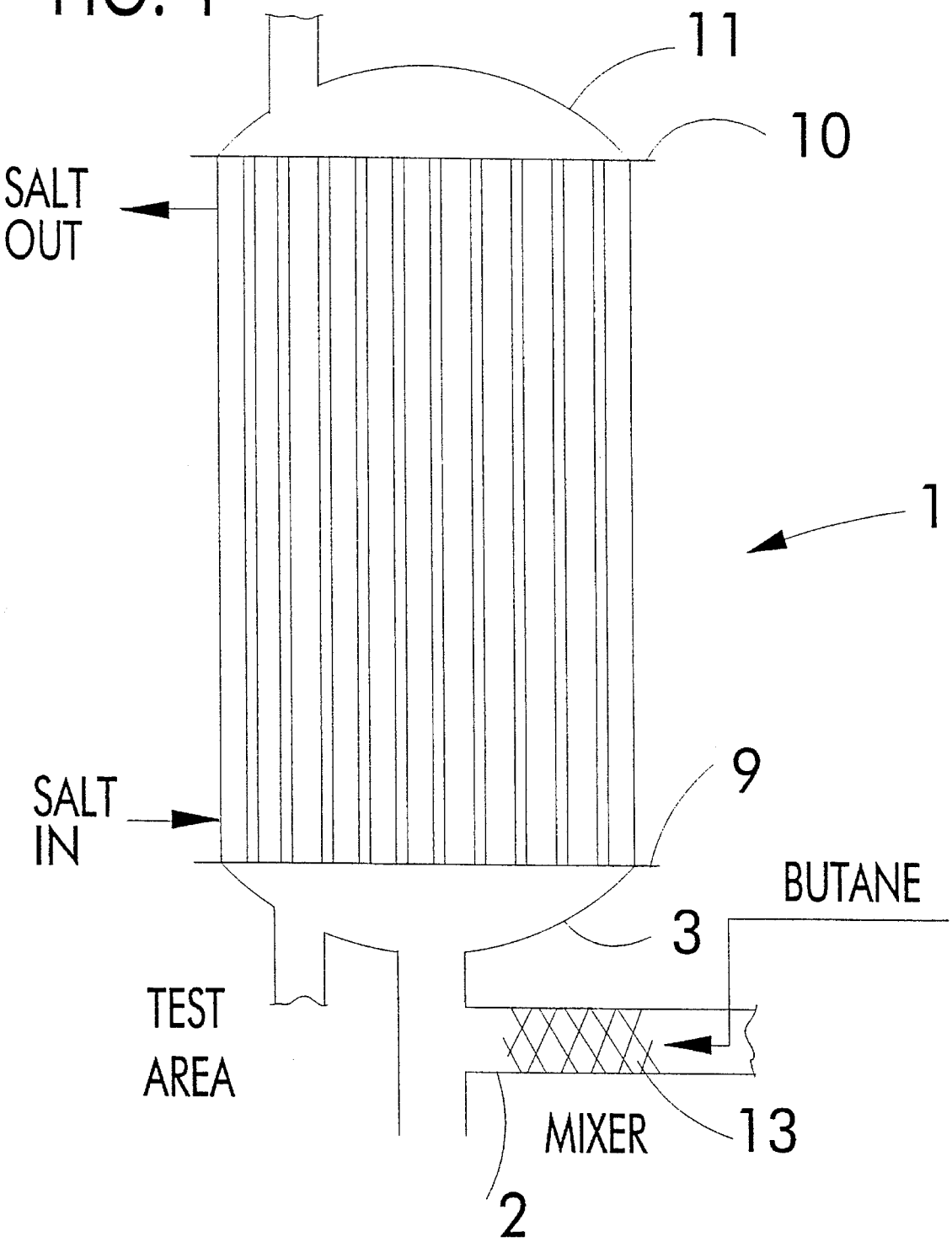
FIG. 1 is a schematic illustration of a reaction vessel of the type to which the invention is applicable.

Referring to FIG. 1, at 1 is shown a shell and tube type reactor for the production of maleic anhydride by vapor phase oxidation of n-butane with atmospheric oxygen in the presence of a phosphorus/vanadium oxide (VPO) catalyst. The reactor comprises a shell through which cooling fluid, typically a salt bath is caused to flow. Tubes containing VPO catalyst extend longitudinally through the shell. An inlet head 3 is attached to one end of the shell by a flanged connection (shown schematically at 9), and an outlet head 11 is attached to the other end of the shell by a flanged connection (shown schematically at 10). A combustible n-butane/air mixture flows through a static mixer 13 in a feed pipe 2, and thence into inlet head 3. Gas entering the inlet head is distributed among the tubes and flows through the tubes over the catalyst into outlet head 11. During passage over the catalyst within the tubes, the n-butane undergoes partial oxidation to maleic anhydride.

Because the gas mixture entering head 3 may be combustible, autoignition can occur if local temperature and pressure conditions are such that the activation energy of the combustion reaction is exceeded, or if features of the surface of the interior of the head act to catalyze the ignition. Also, outside agents, such as sparks, flame kernels and the like can enter the head causing ignition. Thus, there is a substantial risk of ignition either within the head, or in the entry portion of the tubes. Once the reaction has commenced within the tubes, the catalyst serves to direct the reaction, n-butane is rapidly consumed in the production of maleic anhydride, and concentrations of n-butane and oxygen fall below the flammable limit. Thus, the risk of ignition declines as the gas passes into and through the catalyst bed within the tubes. Accordingly, the primary need for monitoring the location of ignition is within the head and the entry portions of the tubes.

Figure 2:
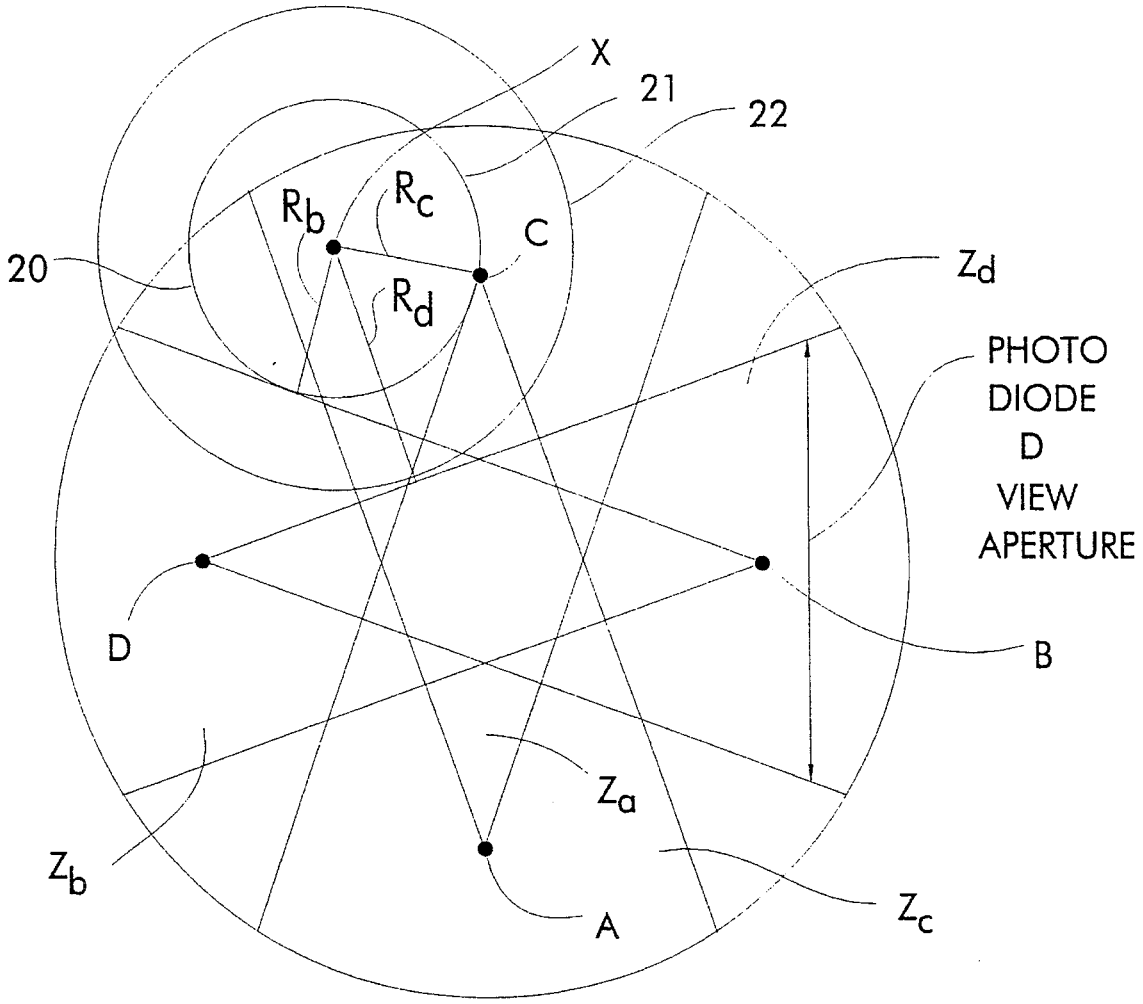
FIG. 2 is a schematic illustration of one embodiment of the data analysis method used in accordance with this invention.

FIG. 2 schematically illustrates the lateral placement of photosensors at a specific longitudinal location within inlet head 2 for detecting an ignition location within the inlet head. FIG. 2 and the immediately following text describe operation of the invention in two-dimensional terms for purposes of simplicity. The time of ignition, $T_a$, is detected by at least one photosensor, A, whose view aperture defines a lateral zone ("ignition zone"), $Z_a$, which encompasses the point of ignition, X. Location of the point of ignition within zone $Z_a$ is provided by a plurality of other photosensors whose lateral view apertures are spaced from the point of ignition, but which are so located as to detect the radial progress of the flame front rather than to detect ignition initially. For purposes of simplicity, only three additional photosensors, B, C and D, and their corresponding zones, $Z_b$, $Z_c$ and $Z_d$, are shown in FIG. 2.

Lateral location of the point of ignition is determined from entry of the flame front into the view aperture of these other photosensors, B, C and D, at measurable successive times $T_b$, $T_c$ and $T_d$, respectively, after the time of ignition. The view aperture of each photosensor defines a zone having an outer boundary of definite shape, for example, shown here as generally triangular having an angle of about 40°. For each photosensor whose view aperture does not encompass the point of ignition X, this boundary ("aperture boundary") is spaced from the point of ignition. When the advancing flame front crosses the aperture boundary of a given photosensor, it is detected by that photosensor. The distance $R_b$ represents the distance of the point of ignition X from the aperture boundary of photosensor B. The distance $R_c$ and $R_d$ represent the distances of the point of ignition X from the aperture boundary of photosensors C and D, respectively. Distances $R_b$, $R_c$ and $R_d$ correspond to the product of the velocity of the flame front and the time it takes from ignition for the front to cross the aperture boundary. Since the velocity of the advancing flame front is assumed to be constant, functions may be determined relating the distance of the ignition point from each view aperture to the velocity, i.e., $V=R_b/T_b=R_c/T_c=R_d/T_d$. If, for example, $T_d$ is 16 milliseconds and $T_b$ and $T_c$ are both 10 milliseconds, circles are constructed in which $R_d$ is 1.6 times the length of $R_c$ and $R_d$. Various combinations of concentric circles meeting these criteria are constructed to represent the advancing flame front. Since the flame front detected by each photosensor emanates from a common ignition point, these circles must be concentric with the common center positioned at the point of ignition. These circles are therefore concentrically positioned and the common center must be within the ignition zone as defined by the photosensor which initially detected the ignition. By trial and error, circles 20, 21 and 22 having radii $R_b$, $R_c$, and $R_d$ are constructed to meet these criteria and positioned with their common center within the view aperture zone $Z_a$ of photodiode A and with their perimeters just entering or in tangential relationship with each respective view aperture boundary. At this position, the common center pinpoints the location of ignition X. It can be seen that by placement of the common center at any other location within zone $Z_a$, the concentric circles are either spaced away from or overlap their corresponding view apertures.

If the ignition location is known, the flame front velocity can be determined, as opposed to assuming a constant velocity as described above. This velocity is a function of the time difference between ignition and entry of the flame front into one or more view apertures, the configuration of the advancing flame front, and the distance between the ignition point and the view apertures. Non-linear flame front velocities can be determined by evaluation of these factors.

The foregoing exemplary description illustrates the general principles of the invention in two dimensions although in practice the actual viewing aperture of each photosensor is three-dimensional, typically conical. Furthermore, this example assumed it is known in advance where along the longitudinal dimension of the reactor the ignition location lies, but in practice this is not necessarily the case. It is therefore necessary to apply comparable analysis to three dimensions. The actual region of the process vessel to be monitored is three-dimensional. Also, where the time of ignition is detected by a photosensor, a sufficient number of photosensors should be used so that the entire volume of the region of interest is covered by their view apertures, that is, so that each potential ignition location within the region is within the view aperture of at least one photosensor.

Further comprehension of the invention is had by consideration of its principles three-dimensionally. The view aperture of each of several photosensors within an ignition zone, including photosensors A and B, has an outer boundary defining a surface having a definite shape, for example, conical, For each photosensor whose view aperture does not encompass the point of ignition, this boundary ("aperture perimeter surface") is spaced from the point of ignition. When the flame front crosses the aperture perimeter surface of a given photosensor, it is detected by that photosensor. Since the distance of the point of ignition from the aperture perimeter surface of each photosensor is the product of the velocity of the flame front and the time from ignition it takes for the front to cross the aperture perimeter surface, another surface can be constructed which is parallel to the aperture perimeter surface and spaced therefrom by the distance the flame front traveled before entering the aperture. If the aperture perimeter surface is generally conical, this other surface will be also. In particular, a conical locus A can be constructed which corresponds to the cone encompassing all points spaced a distance outside the view aperture cone, which distance corresponds to the distance calculated by multiplying the flame front velocity by the time between ignition and the flame front's entering the view aperture. This conical locus defines a locus of points on which the ignition point must fall ("locus of possible ignition points" relative to that photosensor). Similarly, a second conical locus B is defined by the product of the velocity of the flame front and the time it takes from initial ignition for the front to enter the view aperture of photosensor B. The intersection of conical loci A and B defines a curve, typically an ellipse, on which the point of ignition must lie. A third locus C cuts this ellipse at no more than four points, and four, five, or more photosensors having view apertures spaced from the point of ignition are capable of pinpointing the location of the ignition. The region of intersection of a lesser number of loci within the aforesaid ignition zone determines the region of the ignition point, in some instances closely enough for practical purposes.

In certain instances, the exact point of ignition may be determined by a plurality of only three photosensors whose view apertures are spaced from the point of ignition. This may be the case where the intersections of the loci of possible ignition points for each of the three combinations of two of these photosensors define a combination of three planes of which none is parallel to either of the other two, or to the intersection of the other two. In such instance, the intersection of these three planes will identify the exact point of ignition. Depending on the shape of the zone within which ignition is to be detected, it may or may not be possible to array as few as four photosensors so that every point in zone is outside the view aperture of three of them, and the intersections of the loci of possible ignition points meet the criteria noted above. However, this may be feasible whether other constraints limit the range of locations where ignition can occur, e.g., if ignition can occur only on a wall of a reactor vessel. The principle of determining the location of the ignition point by intersection of three planes can be applied in systems which use more than four photosensors.

That the distance of the point of ignition from the perimeter surface of a view aperture spaced from the point of ignition is the product of the velocity of the flame front to the time it takes from ignition to cross the aperture perimeter surface is a principle premised on the assumption that the velocity of the flame front is substantially constant. Since the flame front travels very rapidly, however, this assumption need be valid only for the first few milliseconds of flame propagation. Because there are no known factors within the reaction vessel that accelerate turbulence, this assumption is scientifically reasonable. Where the system includes a sufficient plurality of photosensors whose view apertures are spaced from the point of ignition, it may be possible to generate data from which flame front acceleration or deceleration may be computed. In this instance it may be possible to derive a non-linear function of flame front growth with time and solve for the ignition point without assuming a constant velocity. In most instances, however, such precision is unnecessary.

A further postulate of the method of the invention is that the flame kernel grow in uniformly spherical fashion during the first few milliseconds after ignition. This assumption is scientifically reasonable for the first approximately one meter in diameter, absent factors such as Taylor instabilities due to the differences between burned and unburned gas imparting velocity perturbations capable of wrinkling the flame surface, pressure waves from vent openings, acoustic effects from combustion sound waves bouncing off surfaces, wall effects, and obstacle turbulence. If the flame kernel grows in non-spherical fashion, the precision of ignition detection is compromised, but the ignition point is still accurately determinable within a relatively small region.

The photosensors used are preferably photodiodes having wide band spectral sensitivity extending from long ultraviolet through the visible region to short infrared. One such preferred photodiode is a UV enhanced silicon photodiode available from UDT, Inc. under model number UDT-UV100L. The field of view of this particular photodiode is greater than 145°, but is controlled by associated hardware so as to be significantly smaller when installed. Preferably, the view apertures of the installed photodiodes have a limited angle of divergence, preferably between 30° and 60°, more preferably between about 35° and 50°, most preferably about 40°. If the view aperture angles are more than about 60°, the readings of different photodiodes would not be sufficiently distinct to be meaningful, and/or an excessive number of photodiodes may be needed to provide definitive information on the location of ignition. On the other hand, where the time of ignition is also determined by a photosensor, the angle of divergence is preferably not too narrow, since determination of the ignition time by means of a photosensor requires that every point within the zone in which combustion can occur must be within the view aperture of at least one photosensor.

Figure 6:
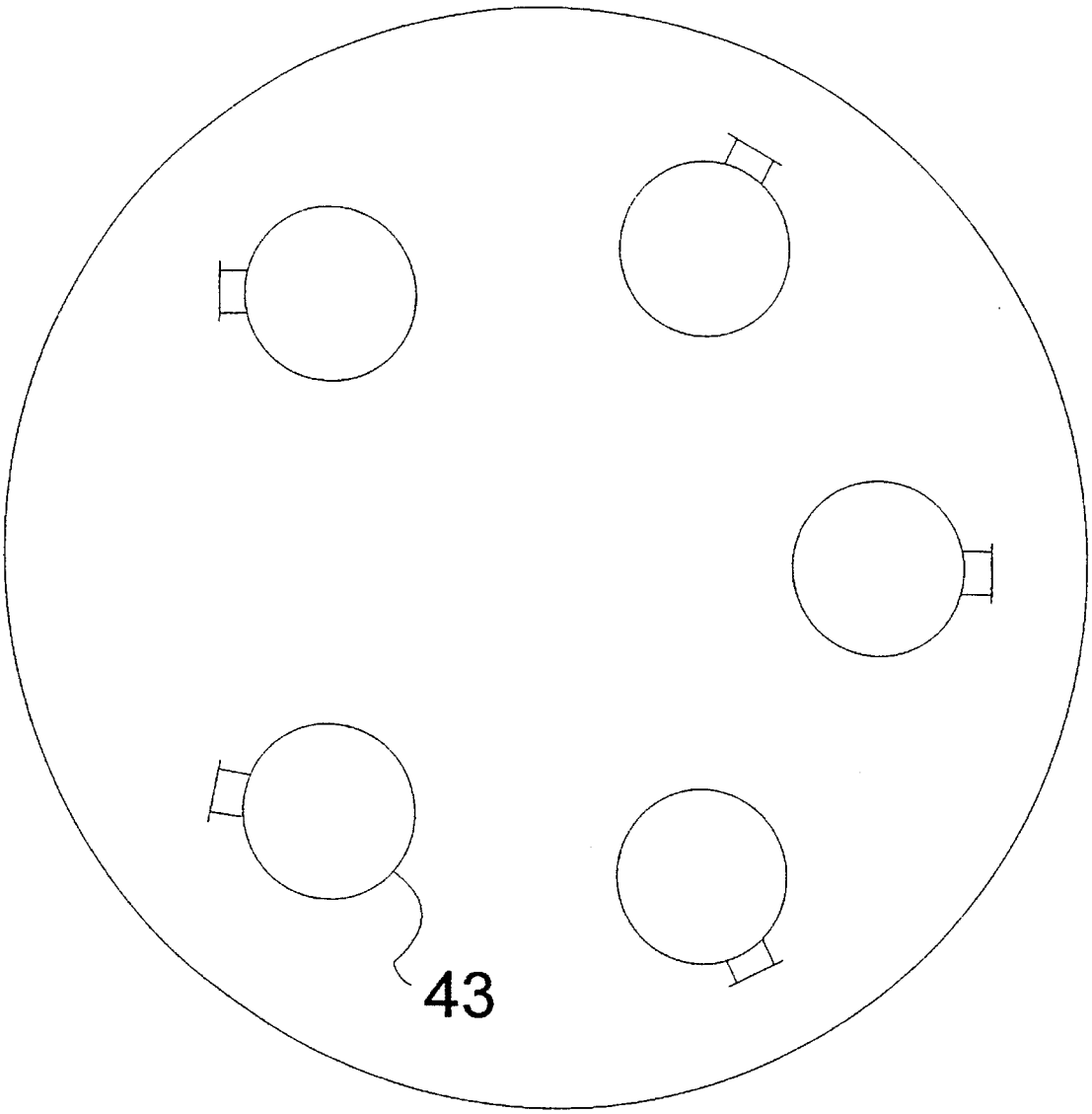
FIG. 6 is a plan view of an arrangement of photosensors on an inlet head of a reactor in accordance with the invention.
Figure 7:
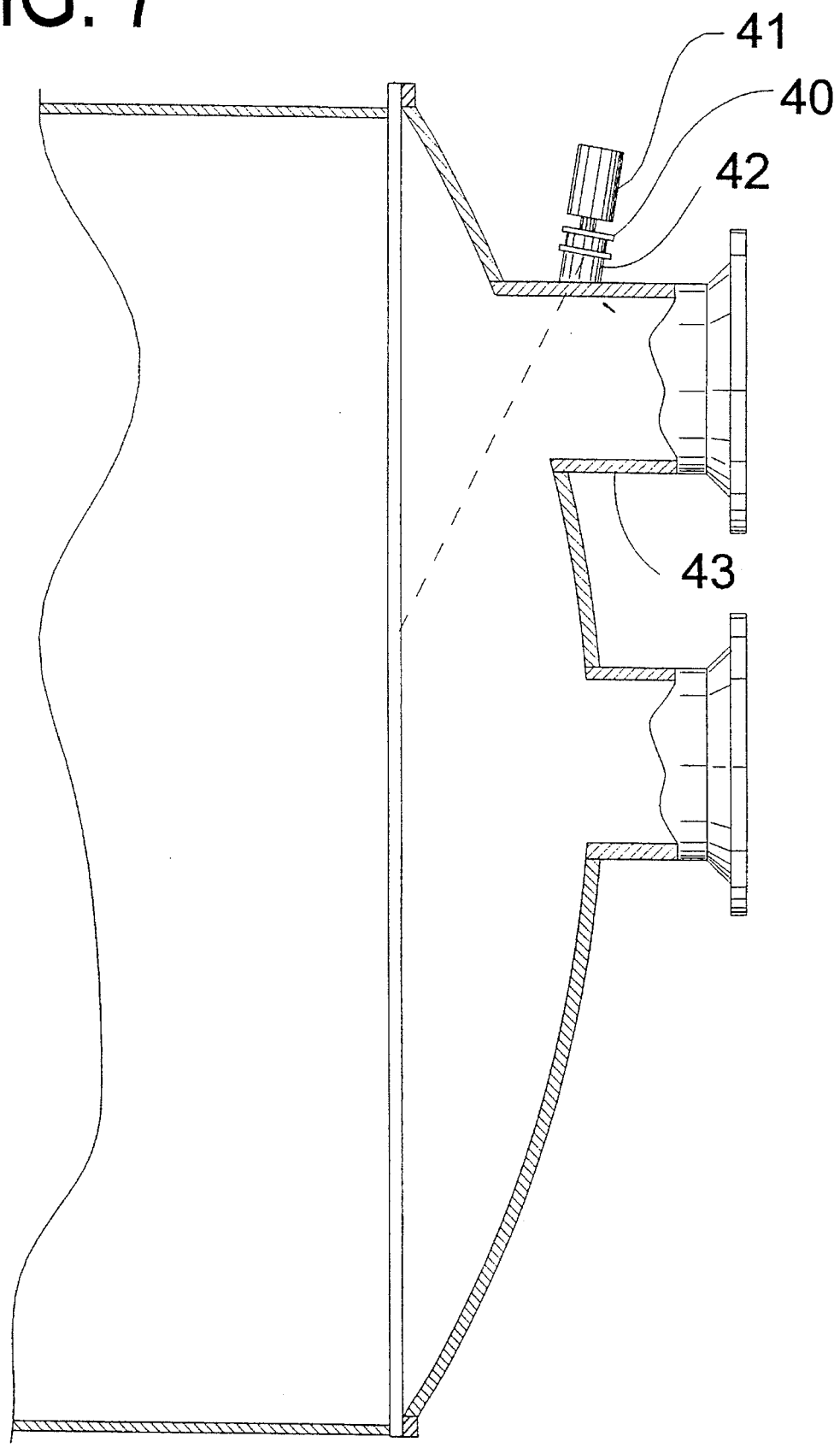
FIG. 7 is a cross section of an arrangement of one photosensor on an inlet head of a reactor in accordance with the invention.

In a preferred embodiment in which the inlet head of a shell and tube reactor for producing maleic anhydride is to be monitored, photosensors are arranged around the inlet head so as to view the interior of the head through windows associated with nozzles incorporated into the vessel wall. The arrangement of the photodiodes and nozzles is shown schematically in FIG. 6. An inlet nozzle in the center of the head is not shown, though one is present in actual practice. The parameters used to control the view aperture are the photodiode nozzle diameter and length, and the distance the photodiode is located from sight glass on the reactor. In one embodiment, the photosensors are photodiodes which view the interior of the inlet head through 3-inch diameter nozzles constructed from schedule 40 pipe. In particular, as shown in FIG. 7, the photosensor assemblies comprise fused glass mounted on a 3-inch, 150-pound flange 40 with an explosion proof housing 41 attached to the nozzle pipe 42 to hold the photodiode electronics. For purposes of simplicity, FIG. 7 shows only one photodiode nozzle and its relation to the inlet nozzle, though in practice there are more than one photodiodes. Suitable glass has 90% transmittance at 400 nanometers. Sight glass installations of this type are available from J. M. Canty Associates of Buffalo, N.Y. The photodiode nozzles are incorporated into 32-inch diameter nozzles 43 comprising rupture disks located around the inlet head as shown in FIG. 6.

The response time of the photodiodes to changes in light intensity is sufficiently fast to permit differentiation between the signals of adjacent photodiodes as the flame front propagates into their respective view apertures at times which differ only in milliseconds. The photodiodes absorb optical power from the flame front and convert it into electrical power. Because the interior of the reaction vessel is essentially black body, a photodiode does not respond significantly until the spherically growing fireball enters its view aperture. Millivolt output from the photodiodes is monitored and recorded over time. Prior to ignition, photodiode output is zero. Following ignition, as the flame front enters each photodiode's field of view, the millivolt output increases until it ultimately reaches a point of saturation. Data interpretation is conducted on that portion of the output where the signal output is increasing at relatively constant velocity, or is conducted on that portion of the output where it just begins to increase for each respective photodiode. Since it is the relative times of the respective diodes responses which is used to locate the ignition point, rather than absolute times, the portion on which data interpretation is conducted is not critical, as long as it is consistent from diode to diode.

Figure 3:
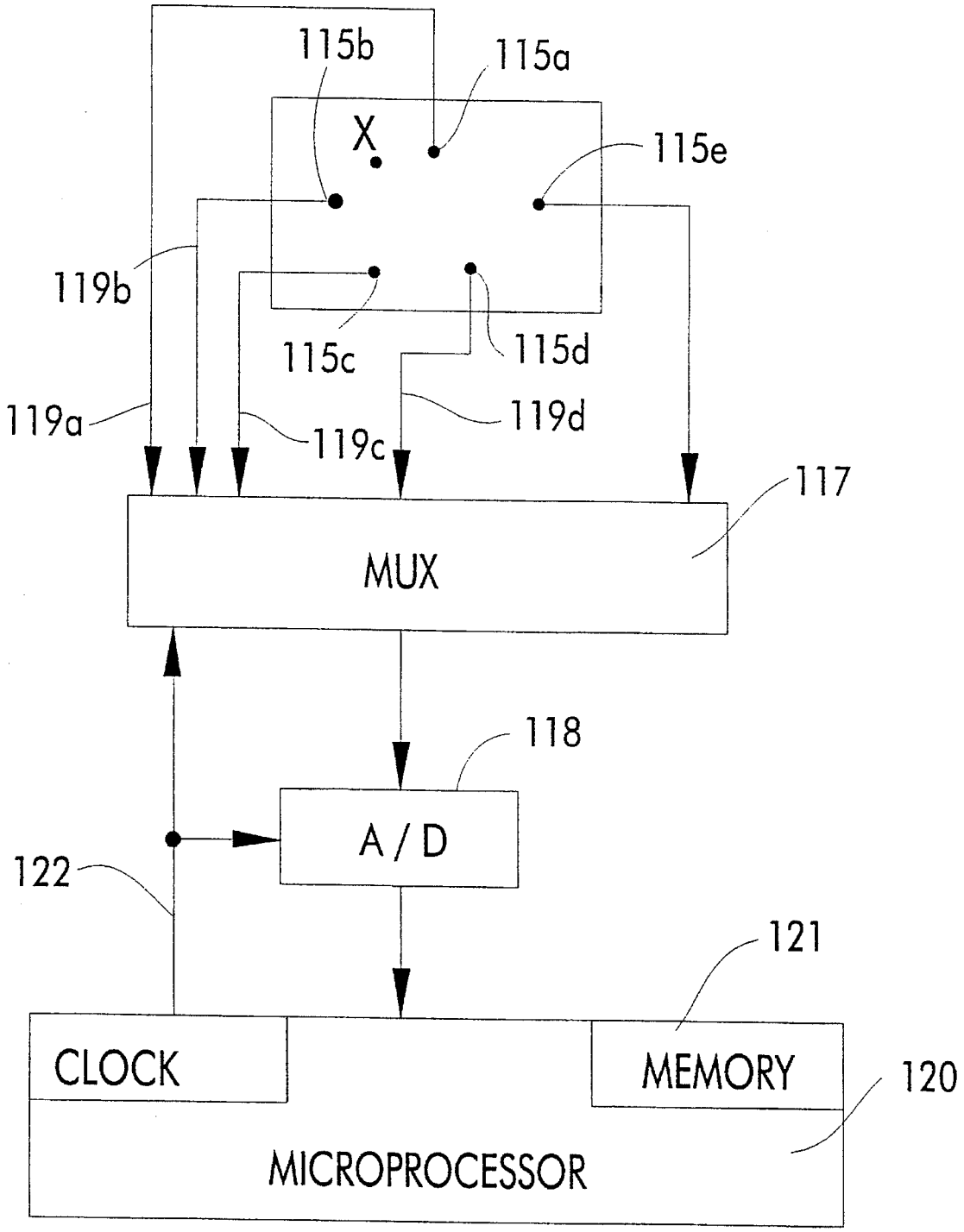
FIG. 3 is a schematic illustration partially in block diagram form of one embodiment of the apparatus of the invention.

A preferred apparatus of the invention is illustrated schematically in FIG. 3. A vessel 103 contains a combustible gas, typically a combustible mixture of hydrocarbon and air flowing through the vessel to a fixed or fluidized catalyst bed. Arrayed within vessel 103 or within a region of interest therein are a number of photodiodes 115*a–e*. For determining the time of ignition, the diodes 115*a–e* are mounted on the vessel wall and arrayed so that every point within vessel 103 is within the view aperture of at least one of the diodes. For example, if ignition occurs at point X within vessel 103 and point X is in the view aperture of photodiode 115*c*, the event of ignition will be detected by diode 115*c*.

Figure 5:
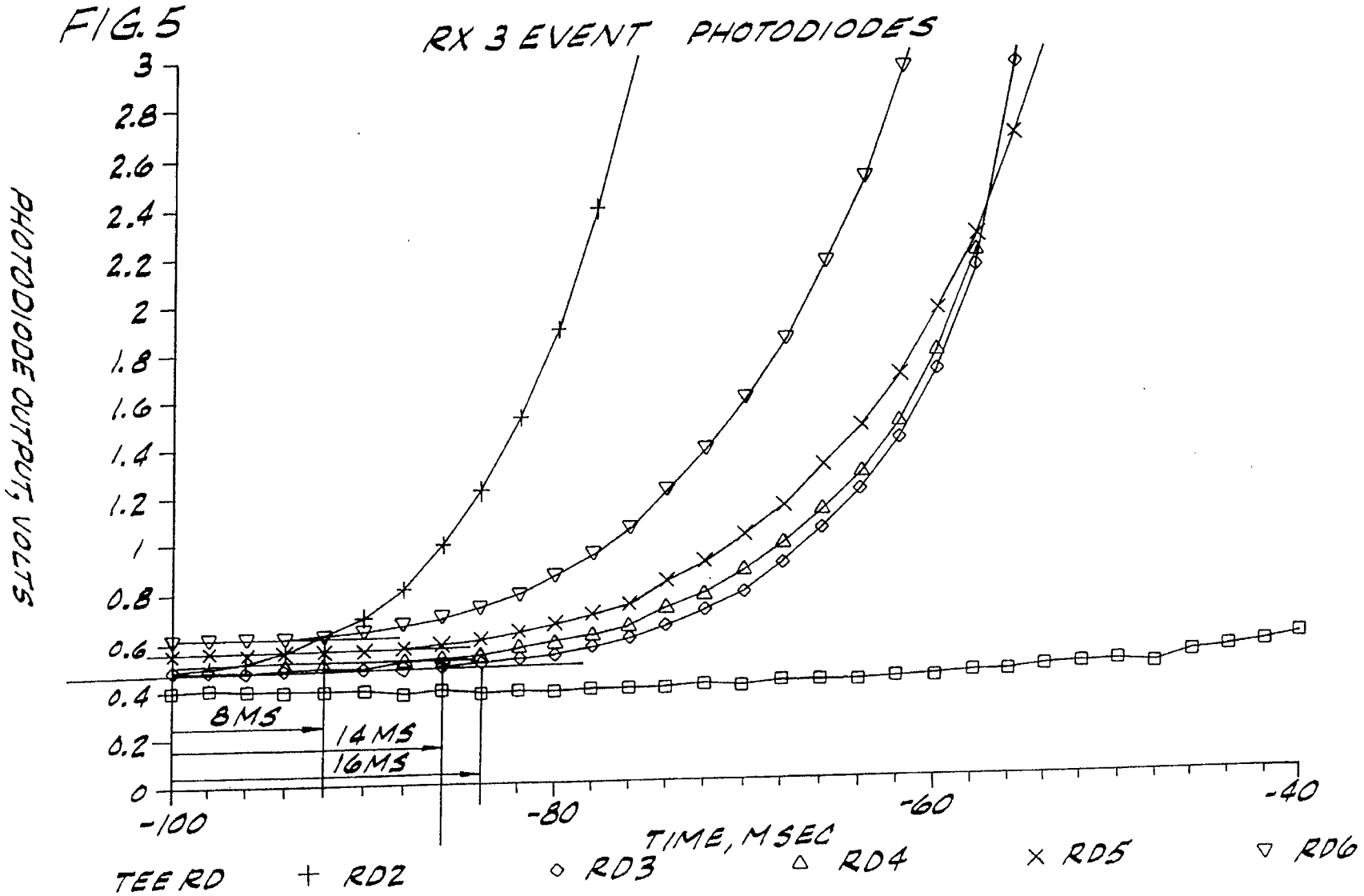
FIG. 5 is a graph of data recorded in accordance with this invention.

At ignition, photodiode 115*c* generates a signal which is transmitted along a signal line 119*c* to a multiplexer 117. The multiplexer transmits the signal to an analog-to-digital converter 118. In general, when the flame front generated by a deflagration propagates from the ignition point and enters the view aperture of each of diodes 115*a, b, d* or *e*, each such diode generates a signal which is transmitted along lines 119*a, b, d* and *e* to multiplexer 117. In response to a clock signal provided via line 122 by a microprocessor 120, multiplexer 117 sequentially transmits the signals to analog-to-digital converter 118. Converter 118 converts the millivolt signals from the photodiodes to digital signals and transmits them to microprocessor 120, which records the relative time of each signals' generation and the magnitude of the signal into its memory 121. A representation of such recordation is presented in FIG. 5. The microprocessor also controls converter 118 and multiplexer 117 via line 122 to control the frequency of sampling of signals from the photodiodes. This arrangement of multiplexer, analog-to-digital converter, and microprocessor represent one preferred embodiment, but this particular arrangement may be substituted with other suitable data recordation arrangements. One preferred data acquisition and analysis system is the Computerscope Enhanced Graphics Acquisition and Analysis (EGAA) system available from R.C. Electronics, Inc. The EGAA system is a fully integrated hardware and software package designed to provide high resolution color graphics for multi-tasking data acquisition and analysis. This completely programmed, menu operated system can digitize and record analog signals while performing multiple signal processing tasks an statistical measurement of recorded data.

As a further option for incorporation into the invention, processor 121 may be programmed to determine, from the time difference for each diode, a function which relates 1) a surface in which the point of ignition must lie, and 2) the velocity of the flame front, as described above. The location of ignition can be computed by comparing such functions and determining the intersection of surfaces which satisfies all of such functions for all of the aforesaid plurality of diodes (i.e., the diodes whose view apertures are spaced from the point of ignition).

Capture of the data from the photodiodes requires use of a microprocessor and associated hardware to record the data at a high rate. In one embodiment, a system is used which records nominally 3000 photodiode data points per second. This frequency of data recordation is adequate since the deflagration event occurs over a time span of between 50 and 100 milliseconds.

In a maleic anhydride reactor, for example, it is generally unknown when a deflagration event will occur, and it occurs only rarely, so the microprocessor records photodiode data continuously, overwriting old information. In a preferred embodiment in which photodiodes are positioned so as to monitor the inlet head of a shell and tube reactor, there are several, preferably five, rupture disks installed in nozzles accessing the reactor head. After an explosion occurs, typically 50 to several hundred milliseconds thereafter, one or more of the rupture disks will rupture, sever a wire and thereby signal the microprocessor to stop recording photodiode information. Overwriting of photodiode data is thereafter avoided and the data during the during flame front propagation is preserved. Since by the time the rupture disk mechanism has been activated the data relevant to the ignition and flame front propagation have been recorded, the continued recordation of data is not necessary.

To determine the location of ignition in the inlet head of a maleic anhydride shell and tube reactor, five photodiodes are preferred, and they are positioned such that all points within the inlet head are within the view aperture of at least one photodiode. After an event, each of the five photodiodes generates a signal at the time entry of the flame front into each diode's respective view aperture is sensed and a recordation is made when the signal is received by the data processing equipment. The length of time (T) between recordation of the first photodiode's signaling of ignition initiation and the subsequent signaling by the other photodiodes having view apertures spaced from the point of ignition yields four T values, $T_b$ through $T_e$. The ratio of the distance of the flame front propagation after ignition (fireball radii $R_b$–$R_e$) to this T equals the velocity of the flame front propagation. In many instances, this velocity may be assumed to be constant, such that $V=R_b/T_b=R_c/T_c=R_d/T_d=R_e/T_e$. In three dimension the ignition location is best determined with the aid of an appropriately programmed computer. The point of ignition is located in two dimensions overlaying circles having the various radii over a schematic representation of the reactor cross section showing the view aperture positions. By trial and error, a common center for all circles is located such that the edge of each circle just touches its corresponding view aperture. This common center corresponds to the ignition location.

Further illustration of the invention is provided by the following example:

EXAMPLE 1

Figure 4:
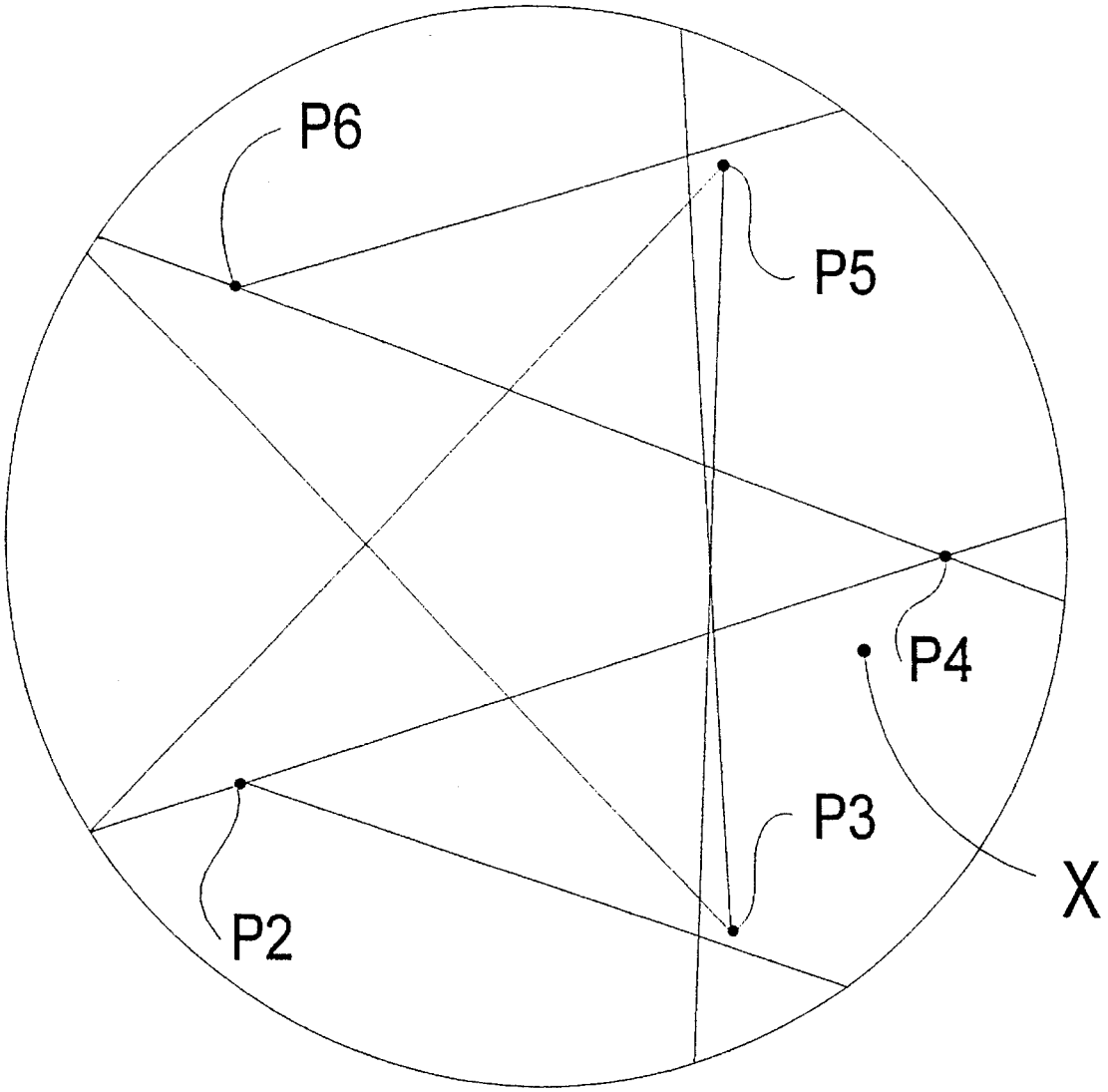
FIG. 4 is a schematic illustration of a preferred arrangement of photodiodes and their view apertures in accordance with this invention.

Photodiodes (P1–P6) were installed in a shell reactor of the type shown in FIG. 1. One of the photodiodes (P1) was installed so as to view inside the inlet piping and five (P2–P6) were installed so as to view inside the inlet head such that every point within the volume of the inlet head was within the view aperture of at least one photodiode. Each of these photodiodes had a view aperture of approximately 40°. The arrangement of these photodiodes is depicted schematically in FIG. 6 with their view apertures depicted schematically in FIG. 4. A process was initiated in the reactor for the production of maleic anhydride by vapor phase oxidation of n-butane with atmospheric oxygen in the presence of a phosphorus/vanadium oxide (VPO) catalyst. After numerous hours of operation, ignition of an explosion occurred which was detected by photodiode P2, causing its millivolt output to increase rapidly. The millivolt outputs of the remaining photodiodes subsequently increased rapidly, all of which were recorded and are presented in FIG. 5. From this data it was determined that the flame front entered the view aperture of photodiode P6 eight milliseconds after detection of ignition by photodiode P2. It was further determined that the flame front entered the view aperture of photodiode P5 fourteen milliseconds after ignition, and of P3 and P4 sixteen milliseconds after ignition. The relative positions of each of the view apertures from the point of ignition was then determined by evaluation of the following ratios: $V=R_6/T_6=R_5/T_5=R_4/T_4=R_3/R_3$; therefore $R_6/8=R_5/14=R_4/16=R_3/16$. From these ratios is was calculated that $R_5$ was 1.75 times as long as $R_6$ and that $R_3$ and $R_4$ were two times as long as $R_6$. By trial and error, potential ignition locations within the view aperture of photodiode P2, which detected the ignition, were evaluated for satisfaction of these ratios until an approximate ignition location was determined. This location is noted as X in FIG. 4. Although it may at first appear from the two-dimensional representation of FIG. 4 that the flame front from an ignition at point X should enter the view aperture of P4 prior to that of P5 or P6, that is not the case because a certain region within the view aperture close to P4, and to each photodiode, is actually not "seen" by the photodiode, because it is blocked by the hardware associated with the photodiode nozzle.

Although specific examples of the present invention and its application are set forth it is not intended that they are exhaustive or limiting of the invention. These illustrations and explanations are intended to acquaint others skilled in the art with the invention, its principles, and its practical application, so that others skilled in the art may adapt and apply the invention in its numerous forms, as may be best suited to the requirements of a particular use.

What is claimed is:

1. A method for detecting a source of ignition in a zone containing a combustible gas by optical measurement of the progress of a flame front generated by the ignition, the method comprising the steps of:

sensing the ignition and measuring the time thereof;

sensing the entry of said flame front into the view aperture of each of a plurality of photosensors and measuring the time of entry of the flame front into each of said view apertures, said plurality of photosensors being so arrayed within said zone that the view aperture of each photosensor of said plurality is spaced from said point of ignition;

for each of said plurality of photosensors, determining the difference between the time of ignition and the time of entry of the flame front into the view aperture thereof;

from said time difference for each of said photosensors determining a function relating a surface in which the point of ignition must lie to the velocity of the flame front; and by comparison of said functions determining a common location comprising intersections of said surfaces which satisfy all of said functions, said common location constituting the measured location of said ignition.

2. A method as set forth in claim 1 wherein said velocity is known or assumed at a fixed value so that, per said function, the distance of said point of ignition from the view aperture of each of said photosensors is equal to the product of the said velocity and said time difference for said photosensor, and said surface comprises a locus of points parallel to and spaced outwardly by said distance from said view aperture.

3. A method as set forth in claim 2 wherein said plurality of photosensors is sufficient so that said location of ignition is determined to be within a region defined by common intersections of combinations of said surfaces for said plurality of photosensors.

4. A method as set forth in claim 3 wherein the number and array of said plurality of photosensors is sufficient to substantially identify an exact point of ignition defined by a common intersection of said surfaces.

5. A method as set forth in claim 3 wherein each of said view apertures is substantially conical, and said surface for each said photosensor comprises a substantially conical surface parallel to said view aperture and spaced therefrom by the distance from said point of ignition to said view aperture.

6. A method as set forth in claim 1 wherein, for each of three intersecting planes within a said zone, substantially every point in the plane within said zone is spaced from the view aperture of at least two photosensors of said plurality, said planes being so oriented that no intersection of any two of said planes is parallel to the third of said planes.

7. A method as set forth in claim 1 wherein each point within the zone is spaced from the view apertures of at least three of said photosensors.

8. A method as set forth in claim 7 wherein each point within the reactor zone is spaced from the view apertures of at least four of said photosensors.

9. A method as set forth in claim 8 wherein each point within the zone is spaced from the view apertures of at least five of said photosensors.

10. A method as set forth in claim 9 wherein said zone comprises the interior of the inlet head of a tubular reactor.

11. A method as set forth in claim 10 wherein said reactor comprises a catalytic shell and tube reactor wherein the tubes contain a catalyst for an exothermic catalytic reaction between components of said gas, and a cooling liquid is flowed through the shell for removal of the exothermic heat of reaction.

12. A method as set forth in claim 11 wherein said combustible gas contains oxygen and a hydrocarbon having at least four carbon atoms in a straight chain, the hydrocarbon being reacted with oxygen over said catalyst for the preparation of maleic anhydride.

13. A method as set forth in claim 12 wherein said catalyst comprises vanadium, phosphorus and oxygen.

14. A method as set forth in claim 13 wherein said hydrocarbon is selected from the group consisting of 1-butane, 2-butane, n-butane and butadiene.

15. A method as set forth in claim 14 wherein said combustible gas contains at least about 1.7% n-butane and at least about 12% oxygen.

16. A method as set forth in claim 15 wherein said combustible gas contains at least about 1.7% n-butane, the balance substantially air.

17. Apparatus for determining the location of ignition of combustion in a zone containing a combustible gas mixture, comprising:

means for detecting ignition;

means for recording the time of ignition;

a plurality of photosensors arrayed so that their view apertures extend into said zone containing said combustible gas mixture but are spaced from the point of ignition therein, each of said photosensors generating a signal upon entry of the flame front produced by the combustion into the view aperture of such photosensor; and means for recording the time at which each such signal is generated;

whereby, from the time difference between said ignition and the time the flame front enters the view aperture of each of said plurality of photosensors, a function may be determined relating a surface in which the point of ignition must lie to the velocity of the flame front.

18. Apparatus as set forth in claim 17 further comprising means for comparing said functions relating said surface to said velocity to determine a common location comprising intersections of said surfaces which satisfy all of said functions, said common location constituting the measured location of said ignition.

19. Apparatus as set forth in claim 18 comprising a memory for recording the time of ignition and the times of entry of the flame front into the view apertures of the plurality of photosensors, and processing means programmed to compute the ignition location from comparison of said functions.

20. Apparatus as set forth in claim 17 wherein said photosensors comprise photodiodes.

21. Apparatus as set forth in claim 20 wherein said means for detecting ignition comprises a photodiode.

22. Apparatus as set forth in claim 17 wherein said means for recording the time at which each photosensor signal is generated comprises a converter for converting said signal to a digital signal and a microprocessor for recording the digital signal.

* * * * *